United States Patent [19]

Cherington et al.

[11] Patent Number: 4,475,621

[45] Date of Patent: Oct. 9, 1984

[54] SOUND REDUCTION MEANS FOR PULSATING TYPE FURNACE

[75] Inventors: Floyd E. Cherington; Charles W. Adams, both of Carrollton; Elrede F. Schneider, Lewisville, all of Tex.

[73] Assignee: Lennox Industries, Inc., Carrollton, Tex.

[21] Appl. No.: 416,662

[22] Filed: Sep. 10, 1982

[51] Int. Cl.[3] ..... F24H 3/02; F01H 5/00

[52] U.S. Cl. ..... 181/212; 126/110 R

[58] Field of Search ..... 181/212, 227, 222, 198; 110/303; 126/110

[56] References Cited

U.S. PATENT DOCUMENTS

| | | | |
|---|---|---|---|
| 2,916,032 | 12/1959 | Kitchen | 126/116 |
| 3,267,985 | 8/1966 | Kitchen | 158/4 |
| 3,473,323 | 10/1969 | Briggs et al. | 181/227 X |
| 3,614,949 | 10/1971 | Goodgion | 126/110 AA |
| 3,662,738 | 5/1972 | Solka et al. | 126/110 R |
| 4,164,210 | 8/1979 | Hollowell | 126/110 R |
| 4,241,723 | 12/1980 | Kitchen | 126/350 R |
| 4,309,977 | 1/1982 | Kitchen | 126/99 A |

FOREIGN PATENT DOCUMENTS 1380011 1/1975 United Kingdom .

*Primary Examiner*—Donald A. Griffin

*Attorney, Agent, or Firm*—Allegretti, Newitt, Witcoff & McAndrews, Ltd.

[57] ABSTRACT

A gas furnace of the pulsating combustion type having improved sound reduction means comprising an exhaust decoupler body adapted to receive pulsating exhaust gases from the combustion chamber, the exhaust decoupler body having an opening with a silencer tube fixed therein, the silencer tube having an inlet opening receiving the pulsating exhaust gases from the combustion chamber and the silencer tube extending into the exhaust decoupler body and having an outlet opening in the mid-region of said exhaust decoupler body. Outlet means in the form of slots are provided in the length of the silencer tube within the exhaust decoupler body. The silencer tube cooperates with the exhaust decoupler body to dissipate the energy of the pulsating exhaust gases.

Resonator means are coupled to the exhaust pipe which connects the combustion chamber to the silencer tube. The resonator means functions to cancel a portion of the energy of the pulsating exhaust gases before it can actuate the walls of the exhaust decoupler body at their resonant frequency.

Further the sound reduction means includes an air decoupler body enclosing the air valve of the pulsating type gas furnace. The air decoupler body includes imperforate outer walls having an air inlet opening therein, a layer of sound insulating material adjacent to the outer wall and with or without an inner perforated wall, depending on the volume of the air decoupler body, the air decoupler body being constructed and arranged to prevent the reverberation of sound therein and the escape of sound energy from the air inlet opening.

9 Claims, 6 Drawing Figures

SOUND REDUCTION MEANS FOR PULSATING TYPE FURNACE

BACKGROUND OF THE INVENTION

This invention relates to a gas furnace and, more particularly, to a gas furnace embodying a pulsating combustion principle.

Pulsating combustion heater systems have been known and are described in the prior art, See, for example, Hollowell U.S. Pat. No. 4,164,210 and Kitchen U.S. Pat. Nos. 2,916,032 and 4,309,977. Basically in such devices a combustible fuel and combustion air are admitted into a combustion chamber where they are ignited to produce an internal explosion, with resultant generation of heat. Immediately after each such explosion, an accoustically-produced negative pressure in the combustion chamber draws additional air and fuel into the combustion chamber through appropriate valves, whereupon the next explosion occurs and closes the valves until the next negative pressure occurs. Once started, a virtually self perpetuating series of heat releasing explosions are produced with combustion air and fuel being drawn automatically and intermittently through appropriate air and gas inlet valves as needed. In response to the combustion chamber pulses of high pressure, the hot exhaust gases from the combustion chamber are normally expelled forcefully through an exhaust pipe to an exhaust decoupling or expansion chamber from which an exhaust pipe or tail pipe extends to an exhaust flue outlet.

Room air to be heated may be passed by forced draft over the combustion system and then returned in heated condition to the room. To enhance the transfer of heat to the room air, external fins may be provided on the combustion chamber. Additional transfer of heat to the room air may be obtained by providing a heat exchange coil with fins on the tail pipe.

The internal explosions within the combustion chamber cause objectionable loud noise, particularly for a residential application. Various muffler arrangements have been proposed to attenuate the loud noise and consideration has also been given in the prior art to encasing the combustion chamber in sound insulating material that will assist in the absorbtion of the sound and vibration caused. For example, Kitchen U.S. Pat. No. 4,309,977 suggests supporting the combustion chamber of a pulsating combustion apparatus in a concrete casing.

An object of the present invention is to provide a pulsating type combustion air furnace with improved sound reduction means wherein the disadvantages and deficiencies in prior constructions are obviated.

Another object of the present invention is to provide a pulsating type combustion air furnace with sound reduction means comprising an exhaust decoupler body of sheet metal adapted to receive the pulsating gases from the combustion chamber, the exhaust decoupler body having a silencer tube therein with the lower end opening into the mid-region of said exhaust decoupler body and cooperating therewith to dissipate the energy of the pulsating exhaust gases.

A further object of the present invention is to provide an improved gas furnace of the pulsating combustion type having sound reduction means which include a resonator coupled to the exhaust pipe adjacent to the inlet of the exhaust pipe to the exhaust decoupler body for cancelling a portion of the energy of the pulsating exhaust gases before they can actuate the walls of the exhaust decoupler body to their resident frequency.

Still another object of the present invention is to provide a gas furnace of the pulsating type with sound reduction means which includes an air decoupler body enclosing the air valve of said gas furnace, such air decoupler body including a wall structure comprising an imperforate outer member, an intermediate sound insulating member and an inner perforated member, with the wall structure constructed and arranged to reduce the reverberation of sound within the air decoupler body and the escape of sound energy from the air inlet opening in the wall structure.

Other objects and advantages of the present invention will be made more apparent hereinafter.

BRIEF DESCRIPTION OF THE DRAWING

There is shown in the attached drawing a presently preferred embodiment of the present invention wherein like numerals refer to like elements in the various views and wherein.

DETAILED DESCRIPTION OF THE PRESENT INVENTION

Figure 1:
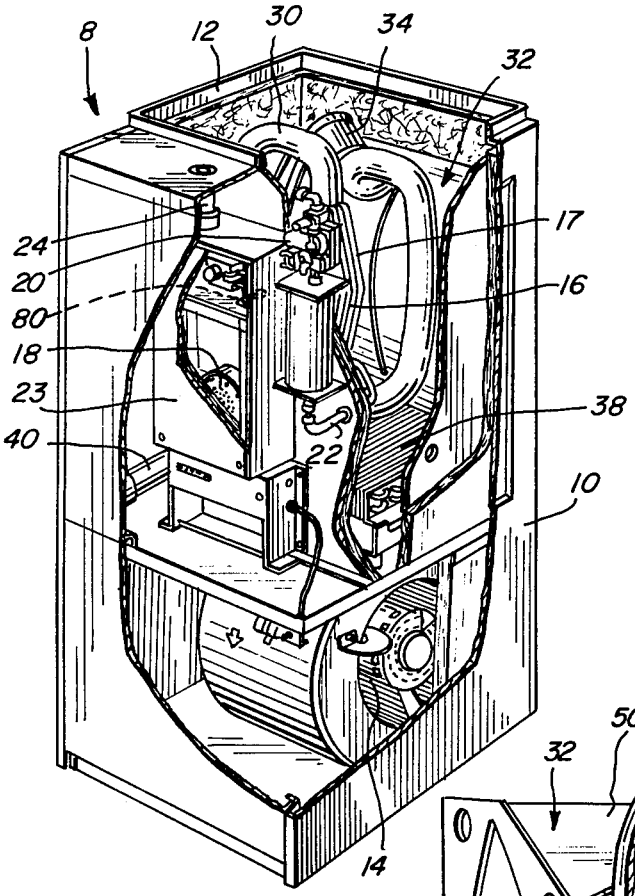
FIG. 1 is a perspective view, with parts broken away, of a gas furnace having a pulsating type combustion chamber and embodying the improved sound reduction system of the present invention.

Referring now to the drawings, there is illustrated a pulsating-type gas furnace embodying the sound reduction system of the present invention. The gas furnace 8 comprises a housing 10 having room air outlet 12 at the upper end and a room air inlet at the lower end. The air is drawn through the housing 10 of the gas furnace by a centrifugal fan 14. While the furnace is illustrated as an up flow gas furnace, it will be apparent to those versed in the art that the sound reduction means of the present invention may be embodied in other forms of furnace.

Supported within the housing 10 is a combustion chamber 6 which communicates with an air valve 18 for receiving combustion air and a gas valve 20 connected to a source of gas for providing the combustion fuel to the combustion chamber 16. The gas valve 20 communicates with the combustion chamber 16 via a conduit 22.

The air valve 18 is disposed in an air decoupler box 23 which forms a part of the sound reduction system of the present invention. The air valve 18 is disposed within a chamber in the air decoupler box 23. The air decoupler box 23 communicates with the air intake pipe 24 for providing a source of combustion air to the combustion chamber 16. The air decoupler box 23 is comprised of a wall structure including an outer wall 25 of sheet metal and an inner wall 26 of sheet metal, with an insulating material 28 disposed between the inner and outer walls. The outer wall 25 is formed of imperforate sheet metal, whereas the inner wall 26 is formed of perforated sheet metal. The insulating material 28 is preferably fiberglass. In a larger size furnace, the inner wall 26 may be dispersed with, as the increased surface area of the insulating material 28 will be adequate to absorbe the sound.

Extending from the combustion chamber 16 is an exhaust pipe or tailpipe 30 which forms a large loop within the housing 10 and communicates at its end remote from the combustion chamber 16 with an exhaust decoupler 32. As will be explained in more detail hereafter, the exhaust decoupler 32 functions to dissipate some of the energy from the pulsating exhaust gases emanating from the combustion chamber 16.

A resonator means 34 is secured to the side of the exhaust pipe 30 just prior to the connection of the exhaust pipe 30 to the exhaust decoupler 32. The purpose of the resonator means 34 is to cancel a portion of the energy of the pulsating gases before it can drive the surface of the exhaust decoupler 32.

The exhaust gases will be discharged from the exhaust decoupler 32 through conduit which communicates with the heat exchanger coil 38. The heat exchanger coil 38 comprises a plurality of thermally conductive conduit connected to fins for enhancing the thermal conducting capability of the heat exchanger coil 38 to transfer heat from the exhaust gases within coil 38 to the room air passing over the coil 38 as it flows through housing 10 from the inlet (not shown) to outlet 12. The spent exhaust gases from the heat exchanger coil 38 pass into the fuel vent pipe 40 for discharge from the gas furnace 10.

Figure 2:
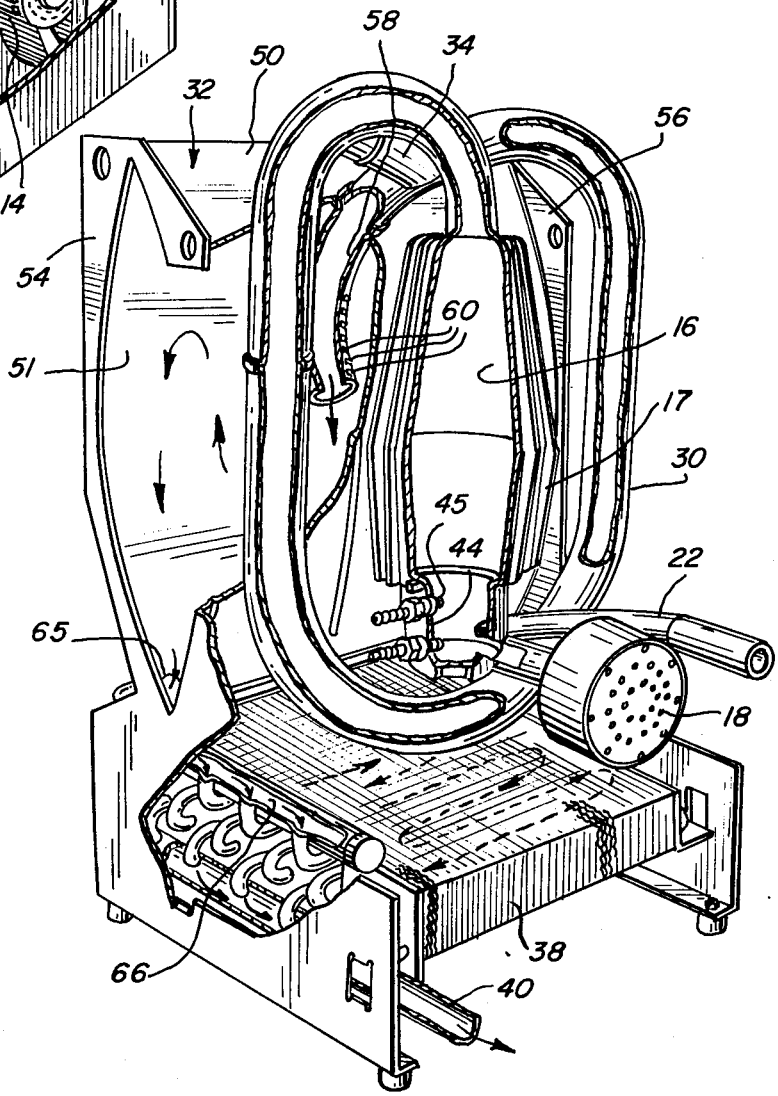
FIG. 2 is a perspective view of the combustion chamber and a major portion of the sound reduction system of the present invention.

Referring to FIG. 2, there are better shown the combustion chamber 16 and the exhaust decoupler 32 of the present invention. Air is supplied to the combustion chamber 16 through the air valve 18 which communicates with the lower portion of the combustion chamber 16 by means of a conduit. Fuel is supplied to the combustion chamber via the conduit 22, which is in communication with the gas valve 20. The air-fuel mixture is ignited by an automotive type spark plug 44 connected to the wall of the combustion chamber 16 initially, and thereafter combustion occurs automatically at a pulsating combustion rate of about 58 to 68 cycles per second. A small quantity of gas is burned (approximately 0.0003 cubic feet natural gas for a 60,000 Btu furnace) producing about one-quarter to one-half BTU during each pulse, depending on the input rate. Above the spark plug 44 is a flame sensor 45 which detects the flame in the combustion chamber 16 and terminates operation of the gas valve 20 if the flame goes out.

Almost complete combustion occurs with each pulse and the force of the controlled explosion creates great turbulence which improves heat transfer and forces the products of combustion through the combustion chamber 16, the tailpipe or exhaust pipe 30, the exhaust decoupler 32, the heat exchanger 38, and out the flue vent pipe 40.

The same force also creates a partial vacuum within the combustion chamber 16, which in turn draws in more gas through the conduit 22 and more air through the air inlet valve 18 that ignites from the retained combustion chamber heat. Gas furnace 8 uses substantially a conventional gas valve that is operatively connected with a pair of free floating reed valves, one for the gas, one for the air.

The combustion chamber 16 is preferably formed from cast metal and is provided with fins 17 thereon for enhancing the heat transfer capabilities thereof. In one form of the present invention, the combustion chamber is about 5.5 inches in diameter and the exhaust tube 30 is about two inches in diameter and about 72inches long, amounting to approximately 0.25 sound wavelengths for optimum operation frequency.

The exhaust gases can be vented from the flue vent pipe 40 through the side of a home in much the same way that a gas-fired clothes dryer would be vented, or alternatively, a small diameter plastic pipe can be run to the top of an existing chimney from the end of the vent pipe 40.

Figure 3:
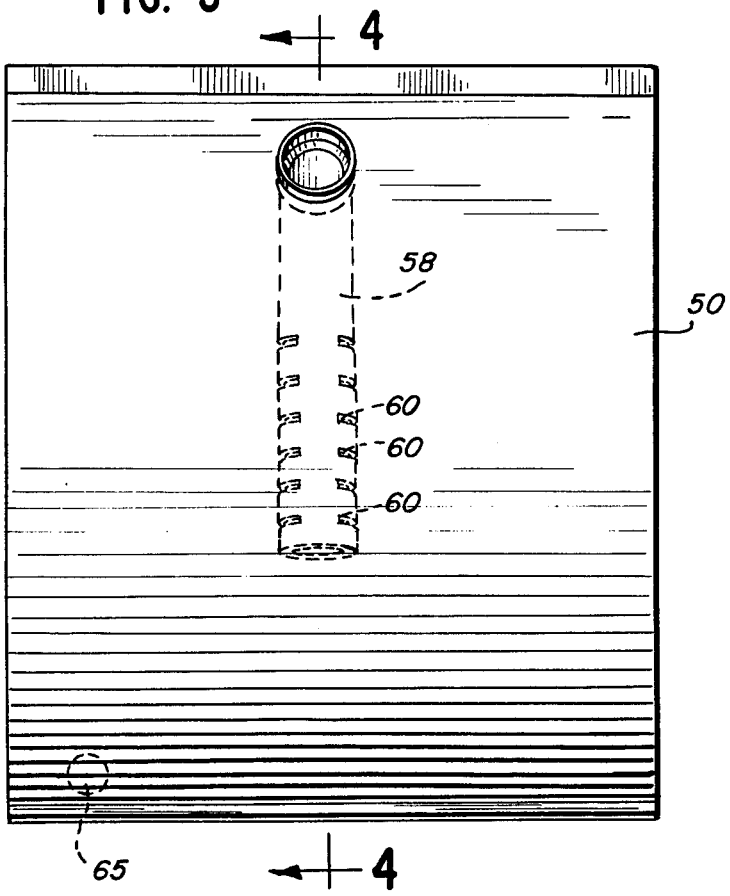
FIG. 3 is an elevation view of the exhaust decoupler body of the sound reduction system of the present invention.
Figure 4:
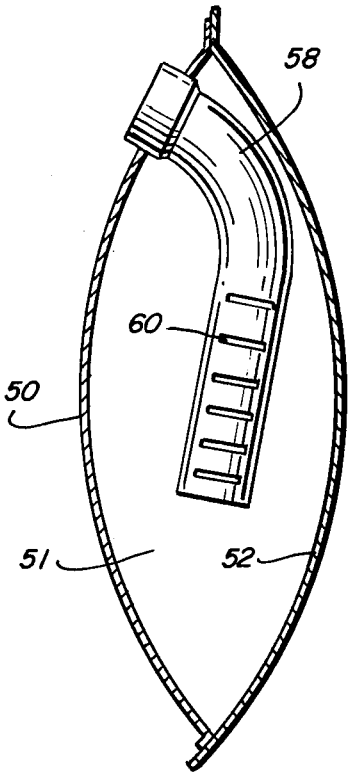
FIG. 4 is a cross-sectional view of the exhaust decoupler body taken generally along the line 4—4 of FIG. 3 and better illustrating the silencer tube disposed within the exhaust decoupler body.

The construction and operation of the exhaust decoupler 32 may be better understood through reference to FIGS. 2, 3, and 4. The exhaust decoupler 32 is preferably fabricated from two sheets of heavy gauge sheet metal 50 and 52 that are closed at the ends by planar sheets 54 and 56. The sheets 50 and 52 are curved in an opposed manner one with respect to the other and define a vertically elongated chamber 51 within the exhaust decoupler 32. A silencer tube 58 is connected in the inlet opening to the exhaust decoupler 32. The silencer tube 58 is in turn connected with the end of the tailpipe 30. The silencer tube 58 is adapted to open into the midregion of the exhaust decoupler 32 and is provided with a plurality of outlet means 60 along its length. Such outlet means 60 comprise slots formed in the surface of the silencer tube. Thus, the major portion of the exhaust gases received in the silencer tube 58 will be discharged directly downwardly from the the midregion of the exhaust decoupler toward the lower end of the exhaust decoupler and a portion of the exhaust gases may be discharged through the slots 68. It is evident therefore that all of the exhaust gases from the tailpipe 30 are forced through the silencer tube by the pulsing action of the combustion chamber 16. The power of each pressure pulse is enough to cause vibration of the walls of the exhaust decoupler, which will radiate sound from its surface into the duct system if the full power of each pressure pulse were allowed to impact the shell of the exhaust decoupler 32. The silencer tube 58 terminates the effective outlet from the tailpipe 30 in the approximate center of the exhaust decoupler 32. In addition, the silencer tube 58 directs the pressure pulse toward the seam at the bottom of the exhaust decoupler 32 and dissipates some of the pulse energy through the slots 60 formed in the silencer tube 58 so that all of the energy of the pulse wave is not expended in one small area of the exhaust decoupler 32. In a presently preferred form of the present invention, there are twelve slots 60 formed in the silencer tube 58 for helping to dissipate the energy of the pulses.

Further, it has been found that the length of the silencer tube 58 added to the tailpipe 30 lowers the firing rate of the gas furnace somewhat so that the higher harmonics of the firing rate do not coincide with the plate vibration frequencies of the exhaust decoupler 32.

The gases from the exhaust decoupler 32 pass through outlet opening 65 into a header 66 and then from the header 66 into each of a plurality of rows of tubes or conduits of the heat exchanger 38. The gases from the heat exchanger conduits are collected in the vent pipe 40 for discharge from the furnace housing 10.

Though not part of the present invention, it is noted that the exhaust gases discharging from the vent pipe 40 are of relatively low temperature—on the order of 100° F. to 120° C. Nitrous oxide emissions in the exhaust gases are approximately one-half that of conventional type gas furnaces.

The low temperature exhaust causes condensation of the water vapor in the flue gases, which returns to the system the heat of vaporization normally lost in conventional noncondensing furnaces. This water may be captured in a drip leg of the flue vent pipe and disposed of in a floor drain.

Because outside air is used in the sealed combustion system, there is virtually no loss of conditioned air from the housing 10 (which must be made up from infiltration) because of combustion or stack dilution.

Figure 5:
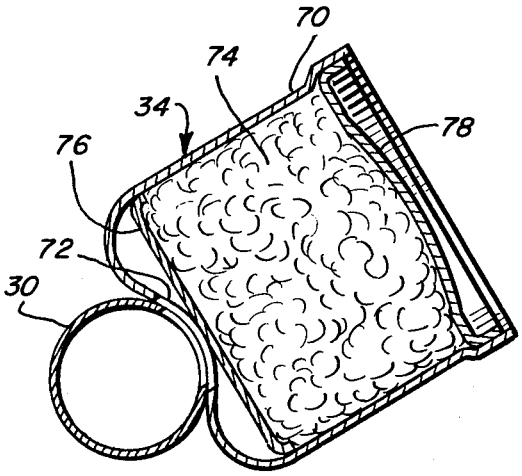
FIG. 5 is a cross-sectional view of the resonator of the sound reduction system of the present invention.

With reference to FIG. 5, there is better illustrated the resonator means of the present invention which forms a part of the sound attentuation or sound reduction system. Basically the purpose of the resonator means 34 is to cancel a portion of the energy in the eigth harmonic of the firing frequency before it can drive the surfaces of the exhaust decoupler 32 at their resonant frequency. The resonator means 34 comprises a body 70 having an opening 72 therein communicating with the tailpipe 30 adjacent the inlet of the tailpipe to the exhaust decoupler 32. Disposed within the body 70 is a metallic sponge 74 in the form of a stainless steel coil in a sponge-like configuration. The sponge 74 is retained between a retainer 76 and the cover 78 which is affixed to the body 70 in a gas tight manner. The resonator body 70 is carefully sized, as is the opening 72 communicating the resonator body 70 and the tailpipe 30, in order to operate at a center frequency of approximately 480 cycles per second. The eighth harmonic of the firing rate varies from about 460 cycles per second at cold start, to about 510 cycles per second at steady state operation. The shift is due to the increase of the speed of sound due to a temperature increase. The exhaust decoupler 32 is naturally resonant at around 480 cycles per second. As the harmonic approaches 480 cycles per second from a cold start, it tries to drive the exhaust decoupler 32 at its resonant frequency. The resonator means 34, which is in the form of a side branch or Helmholz type resonator, reduces this driving frequency to a level that does not drive the exhaust decoupler 32 into resonance. The use of a coiled wire material or sponge-like material 74 within the resonator means 34 broadens the effective band width of the resonator means 34.

Figure 6:
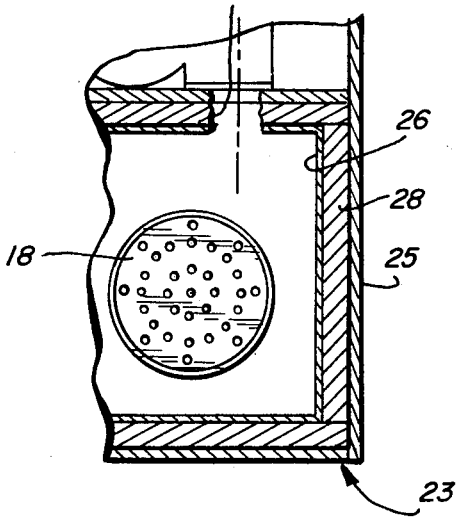
FIG. 6 is a detailed view illustrating the construction of the air decoupler body of the sound reduction system of the present invention.

With reference to FIG. 6, there is better illustrated the manner of reducing the intake air sound level. The air valve 18 is disposed within an air decoupler box 22. The air decoupler box 22 is preferably fabricated from a wall structure which includes outer imperforate walls 25, inner perforated walls 26, and insulating material 28 of fiberglass between the inner and outer walls. In operation, the combustion sound waves can radiate out of the openings in the front part of the air valve 18 during the time that the air valve 18 is closing. The sound waves are partially reflected from the surface of the perforated inner walls 26 and a portion of the incident sound waves pass through the openings in the walls 26 and into the insulating material 28. The sound waves are partially absorbed by the insulating material 28 and are partially absorbed by the outer walls 25. Further, the sound waves are partially reflected by the outer walls 25 back into the insulating material and so on, until most of the energy in the sound waves is dissipated or absorbed by the insulating material 28. This prevents the reverberation of the sound in the lower portion of the air decoupler box 23. If the sound waves were allowed to reverberate, a significant amount of the sound energy could escape through the air inlet opening 76 at the top of the air decoupler box 23 which communicates with the air intake pipe 24. If the air decoupler box 23 is sufficiently increased in volume, it has been found that the perforated inner walls 26 may be omitted and a thicker layer of insulating material may be used for effective sound aborbtion.

There has been provided by the present invention improved sound reduction means for a pulsating type or resonant type furnace, which functions effectively to eliminate the external mufflers in the combustion air line while maintaining an acceptable intake sound level. In addition, the sound reduction means functions to reduce the level of the sound radiated from the surface of the exhaust decoupler and also shifts the firing rate slightly downward. The sound reduction means of this invention also reduces the sound level of the unit during cold start, that is, during the first few minutes of combustion chamber operation.

The pulsating-type furnace produces heat at an unprecedented 90 plus percent heating efficiency. The present invention provides improved sound attentuation means for enhancing the user comfort of such highly efficient pulsating-type furnace. Though a gas furnace has been described, the furnace may be adapted for other fuels, for example, oil.

While we have shown a presently preferred embodiment of the present invention, it will be understood by those skilled in the art that it may be otherwise embodied within the scope of the attached claims.

What is claimed is:

1. In a pulsating type furnace having a combustion chamber with a fuel charge inlet and an exhaust gas outlet, means for admitting successive charges of fuel to the combustion chamber and means for igniting the successive fuel charges, whereby high pressure waves may emanate from the combustion chamber and cause vibration and undesirable sound, the improvement comprising sound reduction means including an exhaust decoupler body adapted to receive a pulsating exhaust gas stream from the combustion chamber, said exhaust decoupler body having an opening with a silencer tube fixed therein, said exhaust decoupler body having opposed curved walls that are formed from sheet metal.

2. A gas furnace as in claim 1, wherein the outlet means in the silencer tube comprise a plurality of slots.

3. A gas furnace as in claim 1, wherein an exhaust gas outlet is provided in a lower portion of one of the walls of the exhaust decoupler body.

4. A gas furnace as in claim 1, wherein the opposed curved walls are elongated vertically and the lower end of the silencer tube opens into the midregion of the exhaust decoupler body.

5. A gas furnace as in claim 1, wherein said sound reduction means includes an air decoupler body enclosing the air valve of said gas furnace, said body including imperforate outer walls having an air inlet hole therein, a sound insulating material adjacent to said outer walls, and inner perforated walls, said air decoupler body being constructed and arranged to prevent the reverberation of sound therein and the escape of sound energy from the air inlet hole.

6. In a pulsating type furnace having a combustion chamber with a fuel charge inlet and an exhaust gas outlet, means for admitting successive charges of fuel to the combustion chamber and means for igniting the successive fuel charges, whereby high pressure waves may emanate from the combustion chamber and cause vibration and undesirable sound, the improvement comprising sound reduction means including an exhaust decoupler body adapted to receive a pulsating exhaust gas stream from the combustion chamber, said exhaust decoupler body having an opening with a silencer tube fixed therein, an exhaust pipe adapted to communicate the combustion chamber to the exhaust decoupler body is connected to the silencer tube, and resonator means is connected to the exhaust pipe for canceling a portion of the energy of the pulsating exhaust gas stream before it can actuate the walls of the exhaust decoupler body at their resonant frequency.

7. A gas furnace as in claim 6, wherein the resonator means comprises a sealed housing having a single opening connected to the exhaust pipe.

8. A gas furnace as in claim 7, including a metallic sponge within the sealed housing for broadening the effective band of the resonator means.

9. In a pulsating type furnace having a combustion chamber with a fuel charge inlet and an exhaust gas outlet, means for admitting successive charges of fuel to the combustion chamber and means for igniting the successive fuel charges, whereby high pressure waves may emanate from the combustion chamber and cause vibration and undesirable sound, the improvement comprising sound reduction means including an exhaust decoupler body adapted to receive a pulsating exhaust gas stream from the combustion chamber, said exhaust decoupler body having an opening with a silencer tube fixed therein, said sound reduction means including an air decoupler body enclosing the air valve of said gas furnace, said body including imperforate outer walls having an air inlet hole therein, and a sound insulating material adjacent to said outer walls, said air decoupler body being constructed and arranged to prevent the reveberation of sound therein and the escape of sound energy from the air inlet hole.

* * * * *